US007815396B2

(12) United States Patent
McFarland et al.

(10) Patent No.: US 7,815,396 B2
(45) Date of Patent: Oct. 19, 2010

(54) REFLECTING WAVE GENERATOR APPARATUS AND METHOD

(75) Inventors: Bruce C. McFarland, Solana Beach, CA (US); Steven M Harrington, Cardiff, CA (US)

(73) Assignee: American Wave Machines, Inc., Solana Beach, CA (US)

( * ) Notice: Subject to any disclaimer, the term of this patent is extended or adjusted under 35 U.S.C. 154(b) by 63 days.

(21) Appl. No.: 11/865,573

(22) Filed: Oct. 1, 2007

(65) Prior Publication Data

US 2008/0085159 A1 Apr. 10, 2008

Related U.S. Application Data

(60) Provisional application No. 60/849,177, filed on Oct. 4, 2006, provisional application No. 60/904,202, filed on Mar. 1, 2007.

(51) Int. Cl.
*E02B 3/00* (2006.01)

(52) U.S. Cl. ..... 405/79; 4/491

(58) Field of Classification Search ..... 405/79; 4/491, 507; 472/128

See application file for complete search history.

(56) References Cited

U.S. PATENT DOCUMENTS

| | | | | |
|---|---|---|---|---|
| 2,406,413 | A | 8/1946 | Test | |
| 3,105,456 | A * | 10/1963 | Gongwer | 116/27 |
| 3,350,724 | A | 11/1967 | Leigh | |
| 3,473,334 | A | 10/1969 | Dexter | |
| 3,577,570 | A | 5/1971 | Vincent | |
| 3,629,877 | A * | 12/1971 | Schuster et al. | 4/491 |
| 4,276,664 | A | 7/1981 | Baker | |
| 4,467,483 | A | 8/1984 | Bastenhof | |
| 4,515,500 | A | 5/1985 | Bastenhof | |
| 4,522,535 | A | 6/1985 | Bastenhof | |
| 4,558,474 | A | 12/1985 | Bastenhof | |
| 4,692,949 | A | 9/1987 | Dunn | |
| 4,730,355 | A | 3/1988 | Kreinbihl et al. | |
| 4,730,807 | A | 3/1988 | Miller | |

(Continued)

OTHER PUBLICATIONS

Catherine Greenman, New Ways to Make Waves, Aug. 20, 1998, The New York Times, pp. 1-2.*

(Continued)

*Primary Examiner*—David J Bagnell
*Assistant Examiner*—Benjamin Fiorello
(74) *Attorney, Agent, or Firm*—Manuel F. de la Cerra

(57) ABSTRACT

A wave generating apparatus and method in which a chamber is at least partially submerged beneath a body of water in a pool and is connected to a gas supply for at least partially filling the chamber with gas, displacing water in the vicinity of the chamber. A vent valve is arranged to vent gas rapidly from the chamber so that the water level in the vicinity of the chamber falls, forming a wave trough. A wave reflecting wall is positioned in the pool adjacent the chamber and in the vicinity of the wave trough formation so as to reflect the wave away from the chamber and across the body of water. The chamber may have a flexible wall for displacing water or may be a rigid chamber communicating with the water through a submerged passageway. This apparatus forms a wave trough followed by a wave peak which travels across the pool.

22 Claims, 5 Drawing Sheets

U.S. PATENT DOCUMENTS

| | | | | |
|---|---|---|---|---|
| 4,812,077 | A * | 3/1989 | Raike | 405/79 |
| 4,979,244 | A | 12/1990 | Bastenhof | |
| 4,999,860 | A | 3/1991 | Chutter et al. | |
| 5,098,222 | A | 3/1992 | Robinson | |
| 5,186,578 | A * | 2/1993 | Perslow | 405/79 |
| RE34,407 | E | 10/1993 | Frenzl | |
| 5,342,145 | A | 8/1994 | Cohen | |
| 5,405,250 | A | 4/1995 | Vowles et al. | |
| 5,535,702 | A | 7/1996 | Idbeis | |
| 6,475,095 | B1 * | 11/2002 | Henry | 472/117 |
| 6,729,799 | B1 | 5/2004 | Raike | |
| 6,738,992 | B2 | 5/2004 | Lochtefeld | |
| 6,912,738 | B2 | 7/2005 | Black | |
| 6,920,651 | B2 * | 7/2005 | Roberts | 4/491 |
| 6,932,541 | B2 * | 8/2005 | McFarland | 405/79 |

OTHER PUBLICATIONS

Ocean Dome Water Park, information brochure, p. 2, date unknown.
Groundswell Wave System, Surf Parks Website, http://www.surfparks.com/technology.php?t=groundswell, printed Sep. 2, 2007, earliest date unknown.
Creating The Perfect Wave, by Mark Schrope, Nature vol. 444, 21, pp. 997-999, Dec. 2006.
Technical Information Sheets #1-#6, ASR Ltd. & Aquatic Development Group, dates unknown.
News Release, Aquatic Development Group, Inc., Sep. 2001.
International Search Report/Written Opinion issued in PCT/US2007/080318 on Apr. 24, 2008.

* cited by examiner

REFLECTING WAVE GENERATOR APPARATUS AND METHOD

RELATED APPLICATION

The present application claims the benefit of co-pending U.S. provisional patent application No. 60/849,177 filed Oct. 4, 2006 and co-pending U.S. provisional patent application No. 60/904,202 filed Mar. 1, 2007, the contents of each of which is incorporated herein by reference in its entirety.

BACKGROUND

1. Field of the Invention

This invention relates generally to wave generators for making waves in a pool of water or other liquid for recreational or scientific purposes.

2. Related Art

Existing systems for making waves use water pumping or rapid air pumping machines to primarily push water to create the waves. Machines which work in a water environment tend to require excess maintenance. In U.S. Pat. No. 5,098,222, a device is described which avoids water contact by pumping air instead of water. This machine suffers from the problem that the wave so generated is turbulent at first and thereby requires a long wave pool to form into a deep-water wave with an organized circular motion. This and similar machines also are designed to rapidly push water into the pool using either air pressure or elevated water column. Sometimes the elevated water column is created with a vacuum. When the vacuum is released the water column drops in the chamber and elevates the water in the back of the pool. This elevated water surges forward creating a primarily supra-water level wave. In machines without vacuum, but with a source of pressurized air, the pressurized air is released rapidly into the generator chamber when the initial water level is equal to the static level in the pool. Again water is forced into the pool creating a primarily supra-water level wave. This cycle creates the peak of the wave first and not the trough first. Waves so created are similar to a tidal bore as opposed to a deep water wave that shoals upon a beach.

SUMMARY

In one embodiment, a wave generating apparatus has a pool which holds water, the pool having a first and second end, the first end having a back wall, a chamber associated with the pool which is at least partially submerged beneath a water level in the pool and which displaces water in the pool when partially or completely filled with gas, a gas supply connected to the chamber for at least substantially filling the chamber with gas, and a vent valve which releases gas from the chamber, whereby the water level in the pool drops suddenly in the vicinity of the reservoir as the gas is vented from the chamber. This creates a depression or wave trough in the water surface. Gravity changes the water particle motion from downwards to rearwards, which induces water to flow towards the back wall in a rearward surge and reflect off of it. The back wall is positioned and shaped so as to produce the reflected wave. The water rises up the back wall, creating the peak which travels forward following the trough and completing a single circular motion cycle. The trough component leads the peak component as the wave travels forward through the body of water. With this apparatus, the wave starts at a location away from the wave generator, and then moves toward the generator, whereupon it is reflected back into the pool. This results in a more natural wave.

In one embodiment, the chamber is a submerged or partially submerged, air filled bladder located in a rear portion of the pool. The bladder has an air inlet valve and an exhaust valve, or a single two-way valve for both air supply and venting purposes. Air is released rapidly from the bladder through the exhaust valve, which causes the main pool water to fall rapidly at the location of the bladder, forming a trough. The water moves rearward and reflects against the back wall, creating an upward motion followed by forward motion. Together, these effects create a wave which is similar to the deep water waves with its circular motion. This cycle can be augmented by rapidly introducing pressurized air through the air inlet valve timed to increase the height of the wave as it reflects off the back wall of the pool. This augmentation produces a larger wave.

In another embodiment, at least one rear chamber in the pool has an underwater passageway communicating with water in the pool, a gas inlet valve which supplies gas to the chamber, and a vent valve for releasing gas from the chamber. In one wave generating method, air is supplied slowly to the chamber so as to drive water out of the rear chamber, and then air is released rapidly via the vent valve, allowing the main pool water to fall rapidly, making the trough part of a wave first. The water moves rearward and reflects against the back wall, creating an upward motion followed by forward motion, completing the circular motion cycle and creating the wave. Together these create a wave which is much more similar to the deep water waves with its circular motion. In one embodiment, a valve communicating with a pressurized gas source may be opened to rapidly force water out of the chamber and increase the height of the wave peak. In another embodiment, a valve communicating with a vacuum source may be opened in order to apply vacuum to the chamber and increase the rate of exhaust of a gas such as air from the chamber. This lifts the water higher in the chamber and creates a deeper trough to the wave. In a third embodiment, vacuum and pressure are combined in phase to amplify the wave.

In one embodiment, a plurality of rear chambers may be provided in a row at a rear end of the pool, with the rear, wave reflecting wall extending across the front of each chamber, and each chamber having a passageway extending under the wave reflecting wall into the pool. Additionally, one or more submerged chambers may be provided in the floor of the pool spaced in front of the wave reflecting wall. These chambers may be air filled and have vent valves controlled to release air as the wave passes over the chambers, amplifying the wave. The chambers may be refilled with air as the wave passes over. Multiple chambers may be lined up in the direction of wave propagation so that each chamber in turn adds to the wave height by the same method described above.

As compared to prior art wave generating devices for wave pools, which typically push water rapidly into the pool to create the peak of the wave first, this apparatus creates the trough of the wave first by dropping the water level in the pool, which reflects against a back wall or wave reflecting wall, creating an upward and forward motion. This results in a wave which is much more similar to a deep water wave formed naturally, with its upward, circular motion.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a reflecting wave generating apparatus for a wave pool.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
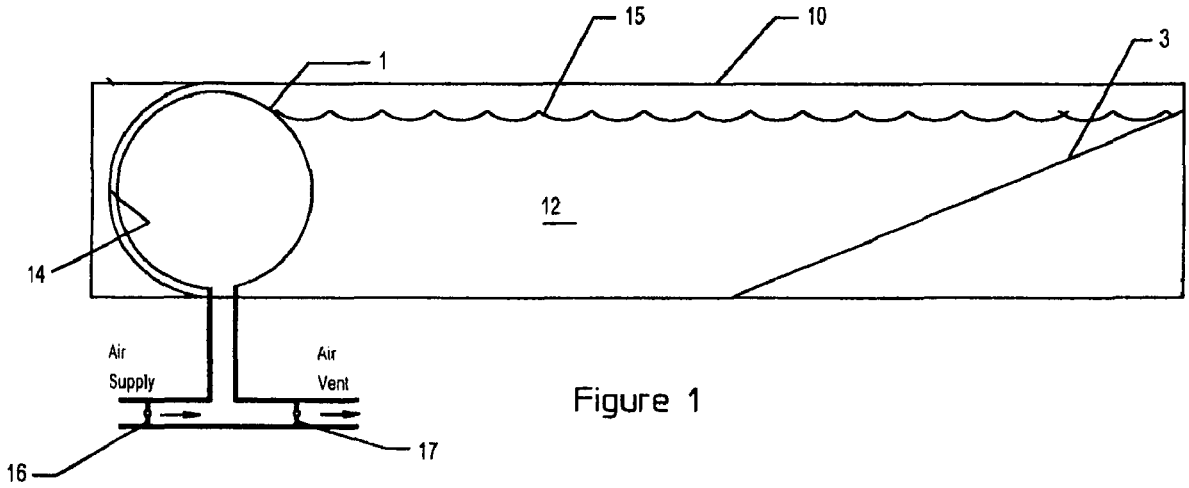
FIG. 1 is a longitudinal sectional view of one embodiment of a reflecting wave generator apparatus in a wave pool.

FIG. 1 illustrates a first embodiment of a wave generator apparatus which comprises a pool or container 10 which contains a body 12 of water, and a collapsible bladder 1 which contains a gas such as air located at one end of the chamber, adjacent a curved, wave reflecting wall 14. The bladder 1 is secured to the floor of the pool. When inflated as in FIG. 1, the bladder is partially or completely submerged beneath the water level 15 of the body of water. The floor of the pool has an upwardly inclined portion or beach 3 at the end opposite to the bladder.

The bladder has an air inlet valve 16 connected to a pressurized air supply, and a vent valve 17 for collapsing the bladder. Initially, the bladder is filled with air or other gas, thereby displacing water in the pool. The bladder is then vented suddenly, and collapses, causing water to flow into the now empty space and forming a wave trough at the rear end of the pool. The water at the bottom of the pool flows into the space left by the collapsing bladder more quickly than the water at the top. This creates a circular motion of the water, which is enhanced by the curved shape of the rear, wave reflecting wall 14. The resultant wave is reflected off wall 14 and moves towards the beach 3, where it steepens and breaks. The process is repeated, with the bladder again being inflated and then vented to create subsequent waves.

Figure 2:
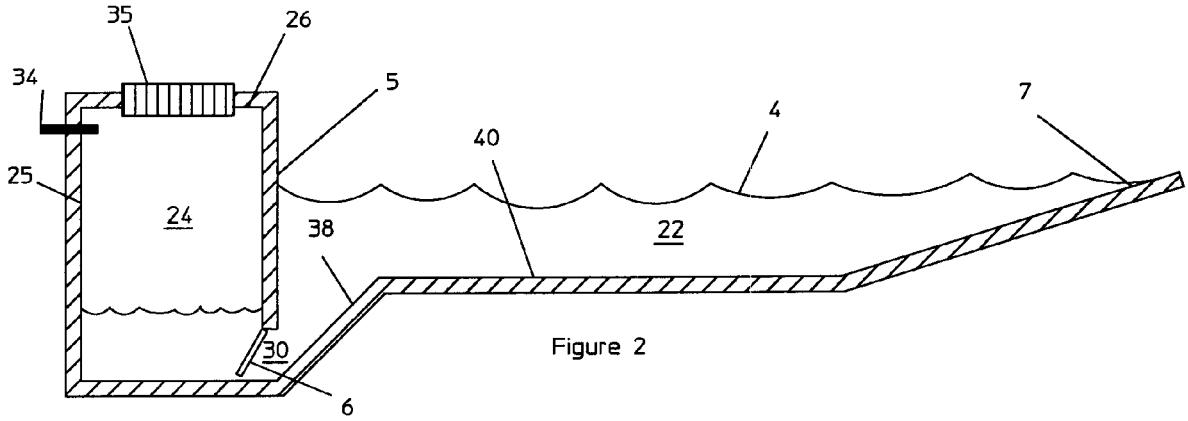
FIG. 2 is a longitudinal sectional view of a second embodiment of a reflecting wave generator apparatus in a wave pool.

FIG. 2 illustrates another embodiment of a wave generating device or apparatus located at one end of a pool 4 containing a body 22 of water. The device comprises a rear chamber 24 having a back wall 25, an upper wall 26, and a wall 5 facing the body of water in the pool and forming a wave reflecting, rear wall of the pool. A passageway 30 at the lower end of wall 5 allows communication between the chamber 24 and the body of water in the pool. A mechanical two-way valve 6 may be located in passageway 30.

Chamber 24 is connected to an air supply through inlet valve 34 located close to the upper end of the chamber back wall 25 and is also connected to a vent valve 35 in the upper wall 26, which may be connected to a vacuum pump. The floor 36 of the pool has a first, upwardly inclined portion 38 extending from passageway 30 away from the wave reflecting wall 5, a generally flat portion 40, and an upwardly inclined portion or beach 7 at the opposite end of the pool.

Figure 2A:
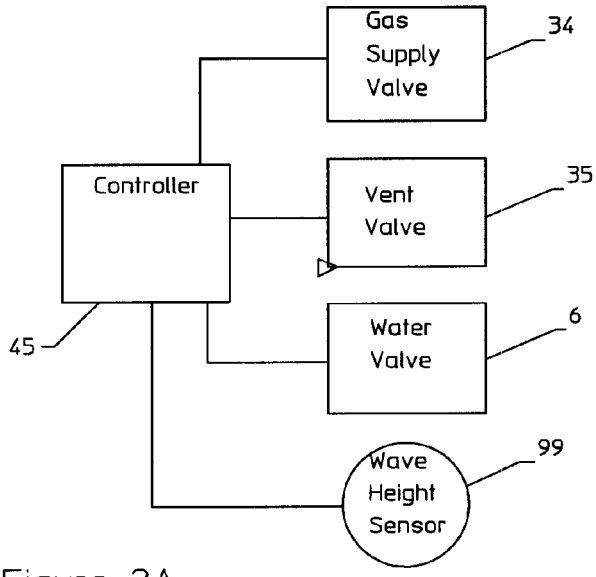
FIG. 2A is a schematic block diagram of a control system for controlling operation of valves in the apparatus of FIG. 2.

As illustrated schematically in FIG. 2A, an electronic controller or computer 45 may be connected to the valves 34, 35 and 6 in order to control the sequence of operation in the manner described below, or the valves may be operated manually. A wave height sensor 99 may be used to provide feedback on the height of the wave. This sensor may be a level sensor or an underwater pressure sensor. This feedback may be used to adjust the valve timing for a given water level or pool configuration.

In operation the rear chamber 24 is first filled with air through valve 34, thereby displacing water into the pool 4. Valve 34 is then closed and the chamber air is vented suddenly through vent valve 35, causing the water to flow from the pool through passageway 30 into the now empty space in chamber 24. The water level in pool drops suddenly, creating a depression or trough in the water that reflects against the back or wave reflecting wall 5 of the pool. This creates a circular motion of the water, which is enhanced by the design of the back wall. The vent valve 35 in the air chamber is shut at the proper time to prevent immediate water resurgence back into the pool which enhances the second trough behind the peak. The mechanical two-way valve 6 can also be used to prevent immediate resurgence. Then the wave thus created moves toward the beach 7, where is steepens and breaks. The water valve 6 may be closed during the initial air fill phase to create a larger air volume in the chamber which, when released, creates a larger depression in the pool. Alternatively, air valve 34 can rapidly supply pressurized air to the chamber after the chamber is filled with water to push water out and amplify the wave peak. Alternatively, vent valve 35 may be connected to a vacuum source such as a vacuum pump, or may be a vent outlet connected via suitable valving either to atmosphere or to a vacuum source.

FIGS. 3 to 9 illustrate a reflecting wave generating apparatus 50 according to another embodiment. This apparatus comprises a plurality of rear chambers 52 positioned in a row at a rear end portion of a pool or container 54 which has a bottom wall 55, a rear end, a forward end, and opposite side walls, and contains a body of water 56. The bottom wall 55 is upwardly inclined along some or all of its length and ends in a beach area 70 at the forward end of the pool. A wave generator plant or control room 58 may be located behind the row of chambers 52 at the rear end of the pool. The chambers have a common, continuous rear wall 60 and a common, continuous forward wall 62, and are separated by dividing walls 64 extending between walls 60 and 62 at spaced intervals. The forward wall 62 forms a wave reflecting wall facing the body of water 56. The chamber rear walls and front walls are shown as straight and perpendicular, but may be staggered or arranged in a slant, arc, or angle shape.

Figure 4:
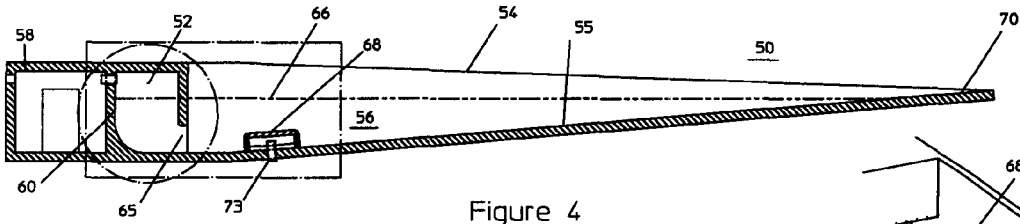
FIG. 4 is a longitudinal section on lines 4-4 of FIG. 3 through a wave generator chamber, showing the sloping pool floor and quiescent water level.

An underwater passageway 65 extends between each rear chamber 52 and the body of water in the pool. As illustrated in FIG. 4, the chambers 52 are partially submerged beneath the quiescent water level 66 in the pool. Each chamber 52 has an air inlet valve 7 and an air exhaust valve 8 located side by side at the upper end of rear wall 60 and directed into plant room 58, as illustrated more clearly in FIG. 5. The inlet valve 7 is connected to an air pumping source in room 58, and the exhaust valve may be connected to atmosphere or external air, with water flowing into the chamber forcing air out through valve 8. Alternatively, the exhaust valve may be a vacuum valve connected to a vacuum source such as a vacuum pump. In another embodiment, a separate valve may be provided to connect the chamber to a vacuum source, and a control system is used to control which of the two valves, i.e. the exhaust valve or the vacuum valve, is used to vent the chamber. A separate, slow fill valve may also be provided in addition to inlet valve 7, or combined slow fill, air inlet, and vacuum valves may be used and connected via a manifold to a single orifice in each chamber 52, with a suitable controller for controlling opening and closing of the valves according to a predetermined wave generating sequence. An optional mechanical water valve may be provided in each passageway 65, similar to valve 6 of the previous embodiment. As in the previous embodiment, a controller 45 or the like may be used to control operation of the valves in the manner described below.

Figure 3:
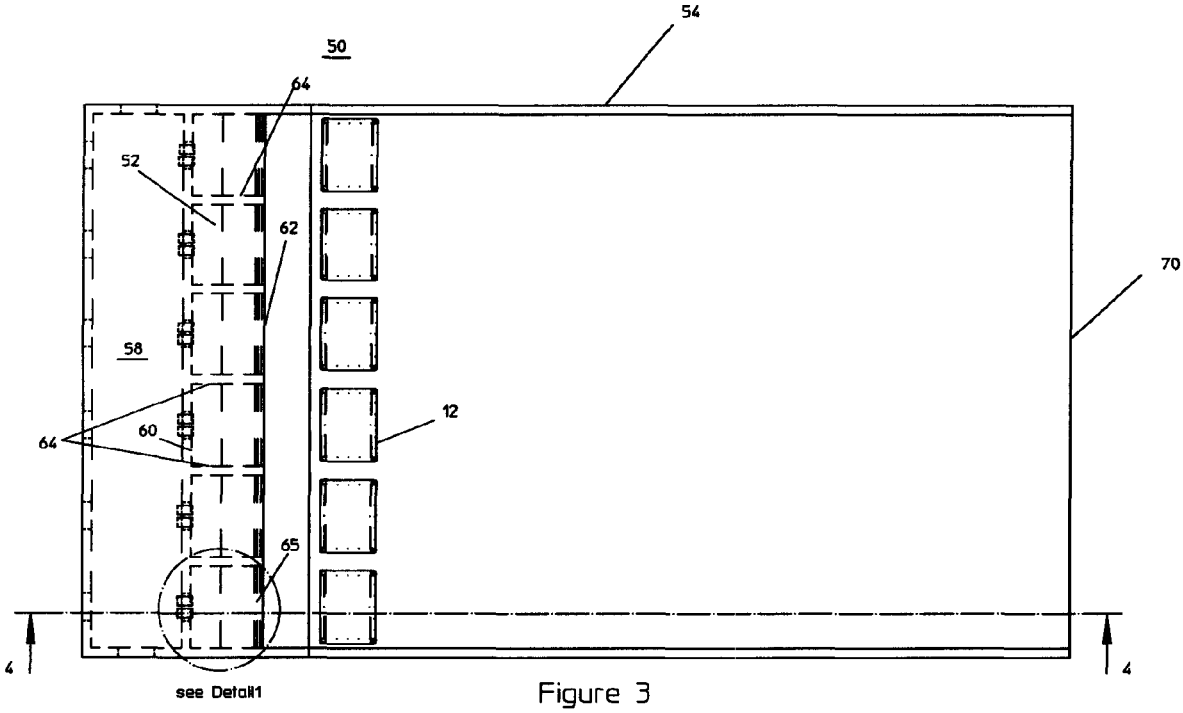
FIG. 3 is a top plan view of a third embodiment of a wave generating apparatus in a wave pool, showing a plurality of wave generators at one end of the pool.
Figure 4A:
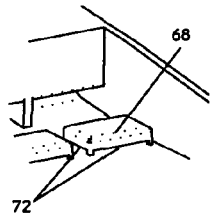
FIG. 4A is an enlarged perspective view of one of the submerged secondary chambers in the pool of FIGS. 3 and 4.
Figure 5:
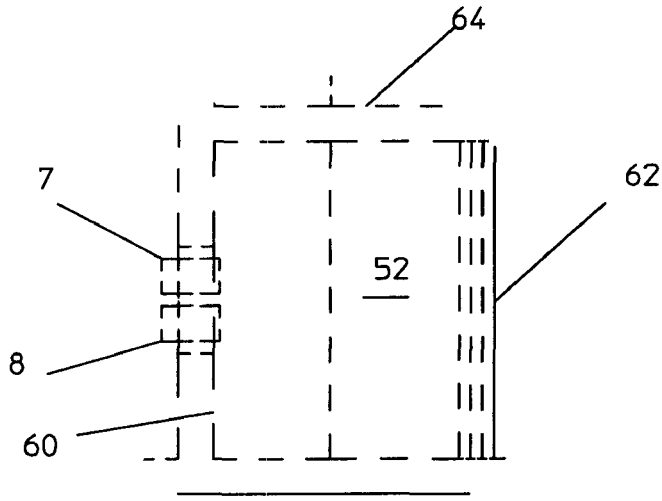
FIG. 5 is an enlarged view of the circled area A in FIG. 3, showing a hidden line representation of the wave generator chamber and valves.

Optionally, a row or rows of submerged, secondary air chambers 68 may be located in the floor 55 of the pool at a location spaced a short distance in front of the chambers 52, as illustrated in FIGS. 3 and 4. As is the case with chambers 52, each secondary air chamber 68 has an air inlet valve and exhaust valve 73. As best illustrated in FIG. 4A, each chamber 68 has openings 72 on each side adjacent the pool floor 55 which communicate with the surrounding body of water. In an alternative embodiment, the chambers could be bladders secured to the floor, as in FIG. 1.

Figure 6:
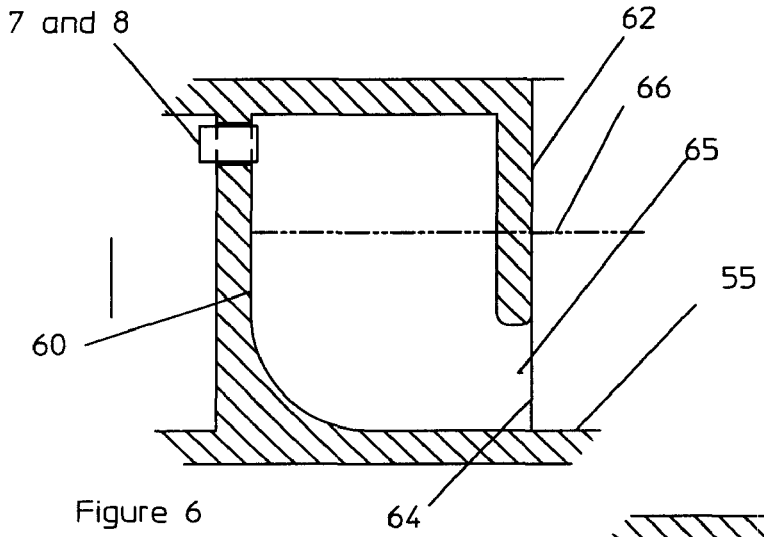
FIG. 6 is an enlarged view of the circled area B of FIG. 4, with a quiescent water level.
Figure 7:
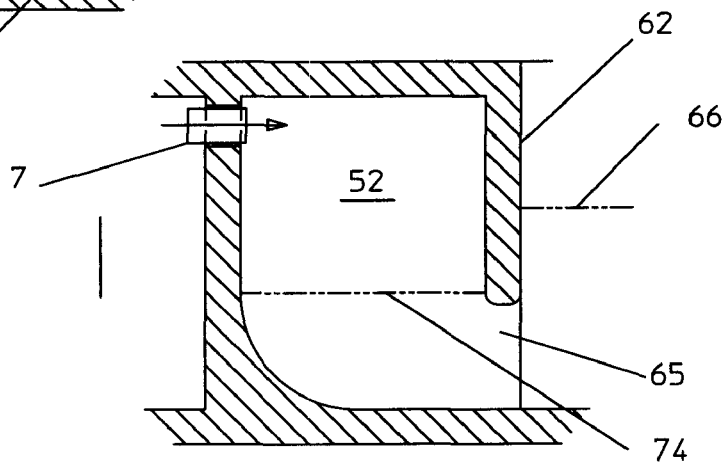
FIG. 7 is a view similar to FIG. 6 showing the start of a wave generating cycle with the water level low in chamber.

The wave generating method is illustrated in FIGS. 6 to 9. At the start of a wave generation cycle, water in chambers 52 is at the same quiescent water level 66 as the body of water in the remainder of the pool, as illustrated in FIG. 6. In one example, air is supplied slowly to the main chambers through valve 7 or a separate slow fill valve, so as to slowly drive water out of the rear chamber, dropping the water in each chamber to water level 74, as seen in FIG. 7, while the water level in the pool adjacent rear, wave reflecting wall 62 remains at the quiescent water level 66. This is a holding position prior to generation of a wave.

Figure 8:
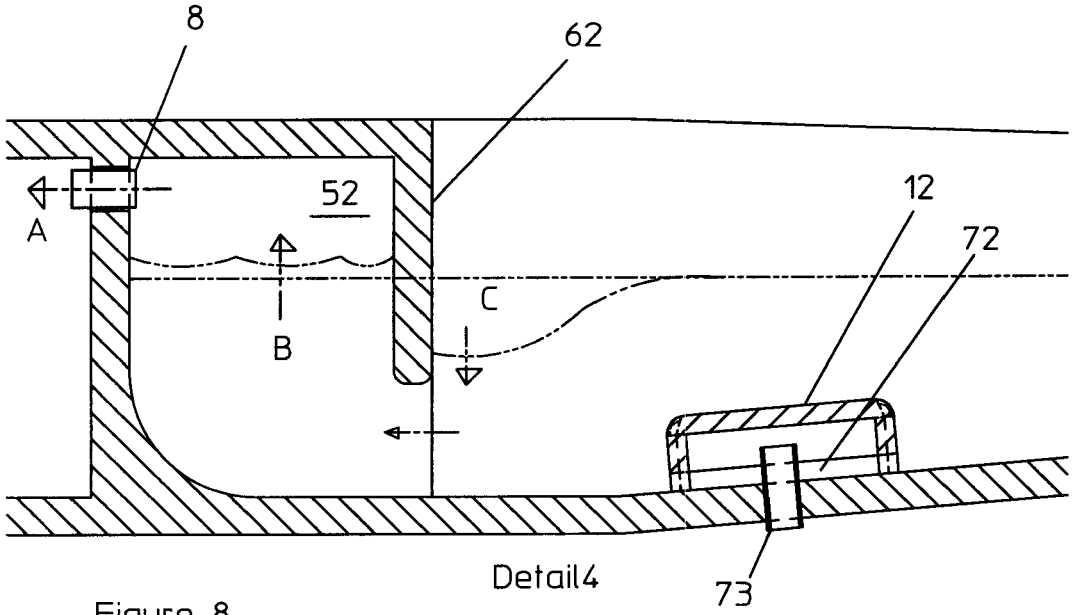
FIG. 8 is a view similar to FIGS. 6 and 7 but showing a subsequent stage in the wave generating cycle.
Figure 9:
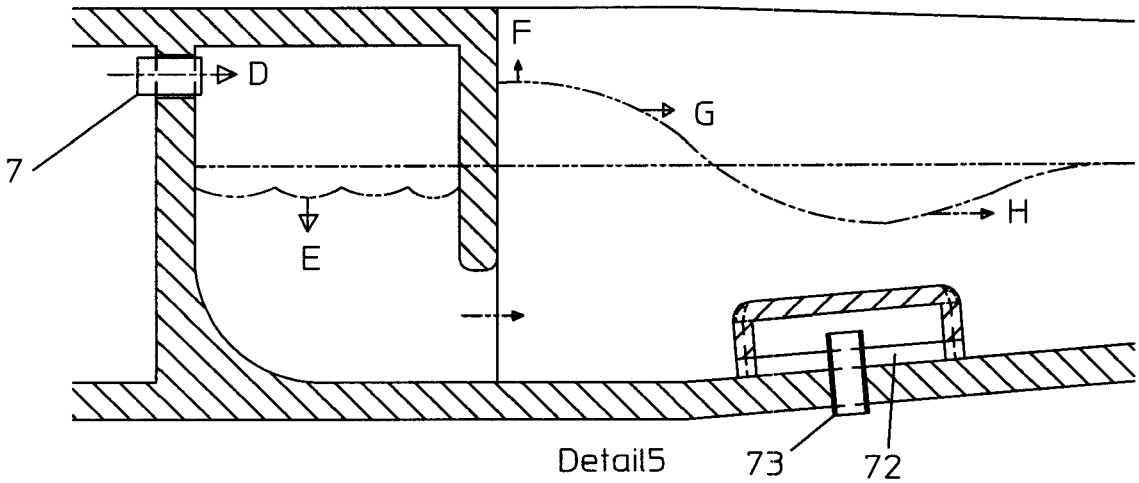
FIG. 9 is a view similar to FIG. 8 but showing a later stage in the wave generating cycle as a wave is being reflected off the back wall.

Air is then released rapidly through vent valve 8 or through a vacuum valve, in direction A as illustrated in FIG. 8, allowing the main pool water to fall rapidly as water rushes into chambers 52 through passageways 65 and starts to re-fill each chamber in direction B. This causes a drop in the water level in the pool adjacent the wall 62, making the trough part C of a wave first, as illustrated in FIG. 8. The water moves rearward, filling trough C, and reflects against the back wall or wave reflecting wall 62, creating an upward motion followed by forward motion. Together these motions create a wave which is much more similar to a deep water wave with its circular motion. This cycle can be augmented by rapidly introducing pressurized air through the air inlet valve timed to increase the height of the wave as it reflects off the back wall of the pool, as indicated in FIG. 9. This augmentation produces a larger wave. As illustrated in FIG. 9, air is forced into the chamber rapidly in direction D through air inlet valve 7, and the water level in chamber 52 falls rapidly in direction E. In turn, this causes the wave in the pool to rise in direction F, and reflect off the back wall 62 in the forward direction G, H. The cycle can be stopped at this point, forming a solitary wave which travels to the second end of the pool and breaks on the beach area 70. Alternatively, the cycle can continue without interruption, oscillating continuously between FIGS. 8 and 9, to form a series of waves which travel across the pool.

A third component to the cycle can be added to further increase the size of the wave. The third component is vacuum applied to coincide with the filling of the wave chamber with water as in FIG. 8, thereby increasing the rate of exhaust of air from the chamber. This lifts the water higher in the chamber during the initial half-cycle creating a deeper trough C to the wave. All together the three components of the cycle, exhaust, vacuum, and pressure work together to create a wave with the trough leading the peak as in FIG. 9 and a circular particle motion in the water.

The submerged, secondary chambers 68 may be used to amplify a pre-existing wave by releasing air from the chambers as the wave trough approaches, so that water fills the chambers and increases the depth of the trough. The submerged chambers are then refilled with air as wave passes over, forcing water out and amplifying the wave peak. Although plural chambers 68 are illustrated, a single, elongate chamber may be used in alternative embodiments. Each of the chambers may be controlled by a controller in a control circuit similar to that of FIG. 2A, with the operation of the secondary chambers 68 appropriately timed after the operation of the primary chambers 52 to create the initial wave trough C. Alternatively a series of secondary chambers or rows of such chambers may be used to further amplify the wave as it travels over.

The reflecting wave generating devices and methods described above create the trough of a wave first, and then water filling the trough reflects off a rear wall of the pool, creating an upward and forward moving peak and circular motion. Together these create a trough followed by a peak which is much more similar to a natural deep water wave with its circular motion. The wave can be enhanced as described above by rapidly introducing air into the chamber through the air inlet valve, timed to increase the height of the wave as it reflects off the back wall or wave reflecting wall of the pool. Further enhancement is provided by applying vacuum to coincide with the filling of the chamber with water, thereby increasing the rate of exhaust of air from the chamber and further increasing the size of the wave. The optional secondary, submerged chambers in front of the rear chambers can be used to further augment the wave size as it passes over these chambers.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A wave generating apparatus, comprising:

a pool which holds a body of water, the pool having a first and second end, and a floor;

a wave reflecting wall in the pool facing the body of water which reflects waves towards the second end of the pool;

at least one wave generating chamber in the pool which is at least partially submerged beneath a water level in the pool and located in the vicinity of the wave reflecting wall, the chamber communicating with the body of water so as to displace water in the pool when partially or completely filled with gas;

a gas supply connected to the chamber;

a vent valve which releases gas from the chamber; and a controller connected to the gas supply and vent valve, the controller actuating the gas supply valve to initially supply gas to the chamber at a pressure higher than atmospheric pressure, and at a first, relatively slow supply rate until the chamber is at least partially filled with gas, simultaneously displacing water in the vicinity of the chamber, and subsequently actuating the vent valve to vent gas rapidly from the chamber via the vent valve at a vent rate higher than the gas supply rate, whereby water flows into the space left by rapidly venting gas from the chamber and the water level in the pool drops suddenly in the vicinity of the chamber adjacent the wave reflecting wall and creates a wave trough which travels towards the first end of the pool and which develops into a wave which reflects against the wave reflecting wall and travels towards the second end of the pool.

2. The apparatus of claim 1, wherein the chamber has a collapsible, flexible wall which is in contact with the body of water to provide communication and is inflatable between a collapsed condition and an inflated condition displacing water in the pool.

3. The apparatus of claim 1, wherein the chamber has a submerged passageway extending through the wave reflecting wall and connecting the chamber to the body of water in the pool, whereby supply of gas to the chamber displaces water into the pool through the passageway and venting of gas from the chamber allows water to flow into the chamber creating a wave trough in the body of water adjacent the chamber.

4. The apparatus of claim 3, wherein the pool has a floor, opposite sides, a rear end, and a forward end, the chamber is located at the rear end of the chamber and the wave reflecting wall comprises a forward end wall of the chamber, the passageway being located at a lower end of the wave reflecting wall adjacent the floor of the chamber, whereby the trough is created in front of the wave reflecting wall and is reflected off the wall.

5. The apparatus of claim 4, wherein the height of the passageway is less than half the height of the chamber.

6. The apparatus of claim 4, wherein the floor of the pool has a first, generally horizontal region forming the base of the chamber up to the passageway, an upwardly inclined portion extending from the passageway, and a second generally horizontal portion extending from the upwardly inclined portion towards the forward end of the pool.

7. The apparatus of claim 3, further comprising a two-way valve in the passageway which is connected to the controller and controls supply of water between the pool and chamber.

8. The apparatus of claim 7, wherein the controller is connected to the two-way water valve and closes the water valve as the trough is created and reflected off the wave reflecting wall to form a reflected wave traveling towards the second end of the pool.

9. The apparatus of claim 3, wherein the gas supply comprises a supply of pressurized air and the chamber has an air inlet valve connected to the pressurized air supply and to the controller.

10. The apparatus of claim 3, further comprising a plurality of wave generating chambers in the pool, each chamber having a submerged passageway connected to the body of water in the pool.

11. The apparatus of claim 1, further comprising at least one submerged chamber at the floor of the pool spaced from the wave generating chamber and wave reflecting wall in the direction of wave travel across the pool, the chamber containing a gas and having a vent valve for venting gas from the chamber as a wave approaches.

12. The apparatus of claim 1, further comprising a vacuum pump connected to the vent valve for rapidly venting gas from the chamber, whereby the water level changes rapidly to create a surface wave.

13. The apparatus of claim 1, further comprising a wave height sensor connected to the controller which senses the height of waves reflected off the wave reflecting wall, the controller adjusting the timing of valve actuation based on the output of the wave height sensor.

14. A method of generating waves in a pool of water, comprising:

connecting a wave generating chamber which is at least partially submerged in a body of water in a pool to a pressurized gas supply;

slowly supplying gas to the chamber at a pressure higher than atmospheric pressure, and at a first supply rate until it is at least partially filled with gas, displacing water in the body of water;

suddenly venting gas from the chamber at a second, vent rate which is higher than the first, supply rate whereby water flows into the empty space, creating a wave trough followed by a peak traveling in a first direction towards a wave reflecting wall at a rear end of the pool facing the body of water in the pool; and reflecting the wave trough and wave peak off the wave reflecting wall to travel in a second, opposite direction across the pool towards a second, forward end of the pool.

15. The method of claim 14, wherein the chamber comprises a flexible bladder and the step of displacing water in the body of water comprises supplying gas to the chamber to inflate the bladder and the step of venting gas comprises deflating the bladder to allow water to flow into the empty space left by the deflated bladder.

16. The method of claim 14, wherein the step of displacing water into the body of water comprises forcing water in the chamber out through a submerged passageway which extends through the wave reflecting wall to connect the chamber to the body of water and the step of venting gas from the chamber further comprises allowing water to flow back into the chamber through the submerged passageway.

17. The method of claim 14, further comprising introducing pressurized gas into the chamber after creation of the wave trough, forcing water out of the chamber to augment the height of the wave peak following the trough.

18. The method of claim 14, wherein the step of venting gas comprises connecting the chamber to a vacuum source.

19. The method of claim 18, further comprising repeating the gas supply and venting steps to create a series of reflected waves.

20. The method of claim 14, further comprising venting gas from a gas-filled, submerged chamber spaced from the wave generating chamber and communicating with the body of water as a wave approaches the submerged chamber so that water fills at least part of the chamber, and supplying gas to the submerged chamber as the wave passes over the submerged gas chamber, forcing water out of the chamber to amplify the wave.

21. The method of claim 14, wherein the first, supply rate is selected to displace water in the body of water without creating a wave which travels across the pool.

22. A wave generating apparatus, comprising:

a pool containing a body of water, the pool having a first end and a second end;

a chamber submerged in the body of water which creates waves in the body of water;

a gas supply connected to the chamber;

a vent valve which releases gas from the chamber;

the chamber communicating with the body of water adjacent the chamber whereby the water level above the chamber is dependent on the amount of gas in the chamber;

a wave reflecting wall located adjacent the wave generating chamber and at the first end of the pool facing the body of water, the wave reflecting wall reflecting waves created by the chamber across the pool from the first end to the second end of the pool; and a vacuum pump connected to the vent valve for rapidly venting gas from the chamber, whereby the water level changes rapidly to create a surface wave which is reflected from the wave reflecting wall at the first end of the pool before traveling to the second end of the pool.

* * * * *